US010872716B2

(12) United States Patent
Maezawa et al.

(10) Patent No.: US 10,872,716 B2
(45) Date of Patent: Dec. 22, 2020

(54) SOFT MAGNETIC FLAKY POWDER AND METHOD FOR PRODUCING THE SAME

(71) Applicant: Sanyo Special Steel Co., Ltd., Himeji (JP)

(72) Inventors: Fumihiro Maezawa, Himeji (JP); Toshiyuki Sawada, Himeji (JP)

(73) Assignee: Sanyo Special Steel Co., Ltd., Himeji (JP)

( * ) Notice: Subject to any disclaimer, the term of this patent is extended or adjusted under 35 U.S.C. 154(b) by 797 days.

(21) Appl. No.: 15/525,422

(22) PCT Filed: Nov. 9, 2015

(86) PCT No.: PCT/JP2015/081507
§ 371 (c)(1),
(2) Date: May 9, 2017

(87) PCT Pub. No.: WO2016/076275
PCT Pub. Date: May 19, 2016

(65) Prior Publication Data

US 2017/0323711 A1 Nov. 9, 2017

(30) Foreign Application Priority Data

Nov. 10, 2014 (JP) ..... 2014-227658

(51) Int. Cl.

| | |
|---|---|
| ***H01F 1/147*** | (2006.01) |
| ***B22F 1/00*** | (2006.01) |
| ***B22F 9/08*** | (2006.01) |
| ***C21D 6/00*** | (2006.01) |
| ***C22C 38/02*** | (2006.01) |
| ***C22C 38/18*** | (2006.01) |
| ***H01F 41/02*** | (2006.01) |
| ***C22C 38/34*** | (2006.01) |
| ***B22F 9/04*** | (2006.01) |

(52) U.S. Cl.
CPC ..... *H01F 1/14775* (2013.01); *B22F 1/0055* (2013.01); *B22F 9/04* (2013.01); *B22F 9/082* (2013.01); *C21D 6/002* (2013.01); *C21D 6/008* (2013.01); *C22C 38/02* (2013.01); *C22C 38/18* (2013.01); *C22C 38/34* (2013.01); *H01F 1/14766* (2013.01); *H01F 41/02* (2013.01); *B22F 2998/10* (2013.01); *C22C 2202/02* (2013.01); *H01F 1/147* (2013.01)

(58) Field of Classification Search
CPC .. H01F 1/14775; H01F 1/14766; H01F 41/02; B22F 9/04; B22F 9/082; B22F 1/0055; B22F 2998/10; C22C 38/34; C22C 38/18; C22C 38/02; C22C 2202/02; C21D 6/008; C21D 6/002
See application file for complete search history.

(56) References Cited

U.S. PATENT DOCUMENTS

| | | | | |
|---|---|---|---|---|
| 7,799,147 | B2 | 9/2010 | Matsukawa et al. | |
| 8,350,559 | B2 | 1/2013 | Fukushima | |
| 8,418,029 | B2 | 4/2013 | Daikokuya | |
| 2007/0221297 | A1* | 9/2007 | Matsukawa | H01F 1/26 148/307 |
| 2009/0146898 | A1* | 6/2009 | Akiho | H01Q 7/06 343/787 |

FOREIGN PATENT DOCUMENTS

| | | | |
|---|---|---|---|
| JP | 200727687 | A | 2/2007 |
| JP | 2007027687 | A * | 2/2007 |
| JP | 200943778 | A | 2/2009 |
| JP | 2009043778 | A * | 2/2009 |
| JP | 4420235 | B2 | 2/2010 |
| JP | 20118663 | A | 1/2011 |
| JP | 201122661 | A | 2/2011 |

* cited by examiner

*Primary Examiner* — Jessee R Roe
*Assistant Examiner* — Rebecca Janssen
(74) *Attorney, Agent, or Firm* — The Webb Law Firm

(57) ABSTRACT

In order to provide a soft magnetic flaky powder that is used primarily in a member for an RFID and that has the high real part μ' of a magnetic permeability and the low imaginary part μ" of the magnetic permeability even when having an average particle diameter of 30 μm or more, and a method for producing the soft magnetic flaky powder, the present invention provides a soft magnetic flaky powder obtained by flattening-treatment of a soft magnetic powder, in which an average particle diameter is more than 30 μm, a coercive force measured by applying a magnetic field in the longitudinal direction of the flaky powder is in a range of 240 to 640 A/m, a saturation magnetization is 1.0 T or more, and an aspect ratio is 30 or more, and a method for producing the soft magnetic flaky powder.

3 Claims, No Drawings

SOFT MAGNETIC FLAKY POWDER AND METHOD FOR PRODUCING THE SAME

CROSS-REFERENCE TO RELATED APPLICATIONS

This application is the United States national phase of International Application No. PCT/JP2015/081507 filed Nov. 9, 2015, and claims priority to Japanese Patent Application No. 2014-227658 filed Nov. 10, 2014, the disclosures of which are hereby incorporated in their entirety by reference.

BACKGROUND OF THE INVENTION

Technical Field

The present invention relates to: a soft magnetic flaky powder used in contactless IC tags, electronic instruments for contactless charging/power feeding, and the like using RFID technologies; and a method for producing the soft magnetic flaky powder.

Background Art

Conventionally, magnetic sheets containing soft magnetic flaky powders have been used as electromagnetic wave absorbers and antennas for RFID (Radio Frequency Identification). In recent years, such magnetic sheets have also been used in position detection apparatuses referred to as digitizers. Examples of the digitizers include an electromagnetic induction type digitizer such as described in Japanese Patent Laid-Open No. 2011-22661 (Patent Literature 1). The digitizer detects an indicated position by reading a high-frequency signal transmitted from a coil included in a tip of a position indicator having a pen shape, with a loop coil included in a position detector having a panel shape.

For the purpose of enhancing detection sensitivity, a sheet which becomes a magnetic path for the high-frequency signal is arranged on the back face of the loop coil. A laminated magnetic sheet in which a soft magnetic flaky powder is oriented in resin or rubber, laminated soft magnetic amorphous alloy foil, or the like is applied as the sheet which becomes the magnetic path. The use of the magnetic sheet enables the entire detection panel to be made as a single sheet, and therefore prevents poor detection in a laminated portion such as the amorphous foil, and the like from occurring, thereby resulting in excellent uniformity.

Conventionally, powders comprising an Fe—Si—Al alloy, an Fe—Si alloy, an Fe—Ni alloy, an Fe—Al alloy, an Fe—Cr alloy, or the like, flaky by an attrition mill (attritor) or the like, have been added to magnetic sheets. This is because it is important to use a soft magnetic powder having a high magnetic permeability, as is clear from so-called "Ollendorff's formula", to use a flaky powder having a high aspect ratio in a magnetization direction to decrease a demagnetizing field, and to highly fill a soft magnetic powder into a magnetic sheet, for obtaining a magnetic sheet having a high magnetic permeability.

In addition to the foregoing, in uses such as RFIDs, it is necessary to prevent losses due to magnetic domain wall resonance, and it is necessary to allow the imaginary part μ" of the magnetic permeability μ of a powder to be low, of the real part μ' of the magnetic permeability and the imaginary part μ" of the magnetic permeability, which real part μ' and imaginary part μ" are the constituents of the magnetic permeability μ. However, in such a production method as reduces μ" to a low level, μ' commonly tends to also decrease. For solving the above, for example, a method for producing a powder, in which a flaky powder has an average particle diameter $D_{50}$ of 5 to 30 μm and a high aspect ratio as properties required for the flaky powder in an Fe—Si—Cr alloy system, and the proportion of a saturation magnetization value to a coercive force value is allowed to be constant is disclosed in Japanese Patent No. 4420235 (Patent Literature 2).

In addition, Japanese Patent Laid-Open No. 2011-08663 (Patent Literature 3) discloses a method for obtaining a powder with μ'≥80 and μ"≤10 by producing a powder having an aspect ratio of 100 to 150 and a thickness of 1 μm or less by using two kinds of crushing balls in a stepwise manner in flattening-processing.

CITATION LIST

Patent Literature

Patent Literature 1: Japanese Patent Laid-Open No. 2011-22661
Patent Literature 2: Japanese Patent No. 4420235
Patent Literature 3: Japanese Patent Laid-Open No. 2011-08663

SUMMARY OF THE INVENTION

In order to produce a fine powder having an average particle diameter $D_{50}$ of 30 μm or less, as described in, for example, Patent Literature 2, a modification in production, such as, for example, a reduction of the particle size of a raw material to 15 μm or less, is required. However, when raw powders are produced using a method such as an atomization method, a classification step is required, yields are also reduced, and therefore, productivity is deteriorated. When a powder is allowed to be fine by long-time flattening-processing, productivity is also similarly deteriorated, and coercive force tends to be easily increased. An increase in coercive force results in a decrease in p' and tends to prevent the required properties from being satisfied. In addition, the optimal range of a heat treatment temperature is unavoidably lowered to 380 to 430° C. in order to avoid sintering that easily results in sintering between powders in heat treatment, in the case of such a thin powder as has a high aspect ratio of 100 to 150 and a thickness of 1 μm or less, as described in Patent Literature 3.

Thus, an object of the present invention is to provide: a soft magnetic flaky powder that is used primarily in a member for an RFID and that has the high real part μ' of a magnetic permeability and the low imaginary part μ" of the magnetic permeability even when having an average particle diameter of more than 30 μm; and a method for producing the soft magnetic flaky powder.

According to an embodiment of the present invention, there is provided: a soft magnetic flaky powder obtained by flattening-treatment of a soft magnetic powder, wherein an average particle diameter $D_{50}$ is more than 30 μm, a coercive force Hc measured by applying a magnetic field in the longitudinal direction of the flaky powder is in a range of 240 to 640 A/m, a saturation magnetization is 1.0 T or more, and an aspect ratio is 30 or more; and a method for producing the soft magnetic flaky powder.

In a preferred embodiment of the present invention, it is preferable to use the soft magnetic flaky powder which comprises an Fe—Si—Cr alloy comprising Si: 15 mass % or less (excluding zero), Cr: from more than 6 mass % to 18 mass %, and the balance of Fe with unavoidable impurities.

Further, in a preferred embodiment of the present invention, it is preferable to use the soft magnetic flaky powder which comprises an Fe—Si—Cr alloy comprising Si: from more than 10 mass % to 15 mass %, Cr: 6 mass % or less (excluding zero), and the balance of Fe with unavoidable impurities.

Further, in accordance with the present invention, there is provided: the soft magnetic flaky powder having a real magnetic permeability μ' of 45 or more and an imaginary magnetic permeability μ" of 1 or less which are magnetic properties in an RFID use or a 13.56 MHz band; or a method for producing the soft magnetic flaky powder.

Further, in accordance with a still another preferred embodiment, the soft magnetic flaky powder can be obtained by implementing a raw powder production step using a gas atomization method or a disk atomization method, a flattening-processing step of flattening the raw powder, and a heat-treating step of heating the flattening-processed powder in a vacuum or argon atmosphere at 500° C. to 900° C.

In accordance with the present invention, there can be provided: a soft magnetic flaky powder that is used primarily in a member for an RFID and that has the high real part μ' of a magnetic permeability and the low imaginary part μ" of the magnetic permeability even when having an average particle diameter of more than 30 μm; and a method for producing the soft magnetic flaky powder, as described above.

DETAILED DESCRIPTION OF THE INVENTION

The present invention will be described in more detail below.

First, details on finding of the conditions described above will be described. It is necessary to allow a value of μ' to be high and a value of μ" to be low in an RFID use, as described above. It is preferable to suppress a loss due to magnetic domain wall resonance in a 13.56 MHz band. The loss due to the magnetic domain wall resonance varies according to a frequency, and the position of the frequency causing a peak migrates according to the physical property values of a material. Thus, it can be considered that the value of the loss at 13.56 Mhz becomes low when a magnetic domain wall resonance frequency is high.

In addition, the magnetic domain wall resonance frequency is considered to be proportional to {saturation magnetization/(magnetic permeability to the power of ½)} (Basic Principles of Magnetic Engineering II, Kyoritsu Zensho). For obtaining properties required for an RFID use, it is preferable to avoid a decrease in magnetic permeability as much as possible, and therefore, it is effective to allow a saturation magnetization to be high. In addition, a magnetic permeability tends to increase with an increase in saturation magnetization or with a decrease in coercive force. Thus, it is found that an increase in saturation magnetization value or a decrease in coercive force value is preferred for increasing a magnetic domain wall resonance frequency and for increasing a magnetic permeability. With regard to a value of μ", a μ"-increasing effect due to an increase in μ caused by a decrease in coercive force and a μ"-decreasing effect due to migration of a magnetic domain wall resonance frequency caused by an increase in saturation magnetization were considered to offset each other.

In contrast, according to the findings of the present inventors, it was found that a coercive force can be reduced to a low value by suppressing oxidation in all of a raw material preparation step, a flattening-processing step, and a heat treatment step as much as possible. In the invention disclosed in Japanese Patent No. 4420235, a stable temperature in heat treatment in atmospheric air or in an inert gas containing oxygen having an oxygen partial pressure of 1% or less is set at 275 to 450° C.

In contrast, the present inventors found that the minimum coercive force is achieved at a higher heat treatment temperature by performing heat treatment in a vacuum or Ar gas. Although the present invention is not bound by any theory, heat treatment at a high temperature is more effective at decreasing a coercive force due to the removal of distortion and the coarsening of crystal grains in a powder than heat treatment at a low temperature.

Specifically, the present inventors found that the optimum condition of a coercive force measured by applying a magnetic field in the longitudinal direction of the flaky powder according to the present invention falls within a heat treatment temperature range of 500° C. to 900° C. depending on the properties of the physical property values (excluding the coercive force) of the flaky powder. In addition, the coercive force can be adjusted to any value depending on a sheet molding condition such as a filling rate.

The powder with a high saturation magnetization and with a low coercive force value measured by applying a magnetic field in the longitudinal direction of the flaky powder, obtained in such a manner, becomes a powder having a low μ" with respect to an increment of μ', thereby obtaining the flaky powder preferred for an RFID use.

<Raw Spherical Powder Preparation Step>

The soft magnetic flaky powder of the present invention can be produced by flattening-treatment of a soft magnetic alloy powder. The soft magnetic alloy powder is a powder preferably having a low coercive force value and more preferably having a high saturation magnetization value. In the Fe—Si—Cr alloy of the present invention, Cr can result in the deterioration of the magnetic anisotropy of a crystal and improvement in corrosion resistance. However, the excessive amount thereof unfavorably causes the coercive force of the soft magnetic flaky powder to be beyond its upper limit that can adjusted by processing conditions and heat-treatment conditions. Therefore, the amount thereof is preferably 18 mass % or less, more preferably 16.5 mass % or less, and still more preferably 15 mass % or less (excluding zero).

In the Fe—Si—Cr alloy of the present invention, Si can result in the deterioration of the magnetic anisotropy of a crystal and a decrease in magnetostriction constant. However, the excessive amount thereof causes a material to be hardened and therefore prevents the average particle diameter of the soft magnetic flaky powder from increasing. In addition, a value of μ' with respect to μ" tends to decrease because a saturation magnetization value becomes low. The amount thereof is preferably 15 mass % or less, more preferably 12 mass % or less, and still more preferably 8 mass % or less (excluding zero).

In the composition of Si: 10 mass % or less and Cr: 6 mass % or less, the powder tends to be intensely sintered in the heat treatment step. The details thereof are unclear, but it can be considered that the sintering occurs at a lower temperature because the powder to which small amounts of Si and Cr are added inhibits oxide films of Cr and Si from being formed. In addition, it is commonly known that a temperature at which a powder starts to be sintered is often lower than the melting point of a bulk material. Further, it is easy to form a powder having an average particle diameter and an aspect ratio increasing with increasing the rate of Fe. Therefore, it can be considered that in the heat treatment step, the area of a contact portion between powders is enlarged to promote the sintering.

It can be considered that the heat treatment method in the present invention is not effective in the composition of small amounts of Si and Cr due to the multiple effects described above. Therefore, it is preferable to set a lower limit to the composition of either Si or Cr. In other words, Cr is preferably more than 6 mass % and more preferably 7 mass % or more when Si is 10 mass % or less. Alternatively, Si is preferably more than 10 mass % and more preferably 12 mass % when Cr is 6 mass % or less.

The soft magnetic alloy powder of the present invention is produced by various atomization methods such as a gas atomization method and a water atomization method. Because the amount of oxygen contained in the soft magnetic alloy powder is more preferably smaller, the production by the gas atomization method is preferred, and the production using an inert gas is still more preferred. Although the production is also enabled without any problem by a method with a disk atomization method, the gas atomization method is superior from the viewpoint of mass productivity. The particle size of the soft magnetic alloy powder used in the present invention is not particularly limited, but the soft magnetic alloy powder may be classified depending on the purpose of adjusting an average particle diameter $D_{50}$ after flattening processing or the other purposes of production.

<Flattening-Processing Treatment Step>

Then, the above-described soft magnetic alloy powder is flaky.

A flattening-processing method, which is not particularly restricted, can be performed using, for example, an attritor, a ball mill, a vibration mill, or the like. Especially, it is preferable to use the attritor having a relatively excellent flattening-processing ability. It is preferable to use an inert gas when the processing is performed in a dry process. It is preferable to use an organic solvent that is capable of suppressing oxidation during the processing when the processing is performed in a wet process; however, the kind of the organic solvent is not particularly limited.

The amount of the added organic solvent is preferably 100 parts by mass or more, and more preferably 200 parts by mass or more, with respect to 100 parts by mass of the soft magnetic alloy powder. The upper limit of the organic solvent is not particularly limited, but can be adjusted as appropriate depending on a balance between the size/shape of a demanded flat powder and productivity. A flattening auxiliary may be used together with the organic solvent, and 5 parts by mass or less of the flattening auxiliary with respect to 100 parts by mass of the soft magnetic alloy powder is preferred for suppressing oxidation.

<Heat Treatment Step>

Then, the above-described soft magnetic flaky powder is heat-treated.

A heat treatment apparatus is not particularly restricted, but it is preferable to perform the heat treatment under a condition of a heat treatment temperature of 500° C. to 900° C. The heat treatment at the temperature causes a coercive force to decrease, thereby resulting in the soft magnetic flaky powder having a high magnetic permeability. A heat treatment time, which is not particularly restricted, may be selected as appropriate depending on a treatment amount and productivity. Because the long-time heat treatment results in deterioration of productivity, the heat treatment time is preferably five hours or less.

The soft magnetic flaky powder used in the present invention is preferably heat-treated in a vacuum or in an inert gas in order to suppress oxidation. For example, the heat treatment in nitrogen is also acceptable from the viewpoint of surface treatment; however, in such a case, the coercive force value of the powder tends to unfavorably increase, and the magnetic permeability value thereof tends to unfavorably decrease.

The soft magnetic flaky powder is preferably a powder having an average particle diameter $D_{50}$ of more than 30 μm. An average particle diameter of 30 μm or less tends to result in difficulty in obtaining the flaky powder having a high aspect ratio and to result in decrease in p'. Further, the coercive force value of a powder having a small average particle diameter tends to be higher than that of a powder having a large average particle diameter. Further, the excessively large average particle diameter is not preferred because of resulting in difficulty in sheet molding. The upper limit should be set in consideration of productivity, convenience in production, and demanded properties, but is preferably 200 μm or less in consideration of sheet moldability.

It is preferable that the coercive force Hc of the soft magnetic flaky powder is 240 to 640 A/m. A coercive force of more than 640 A/m is unfavorable because of making it impossible to secure a value of μ' and of making it difficult to obtain demanded properties even if sheet molding is devised. Further, an extremely low coercive force is unfavorable because μ" in a 13.56 MHz band is increased due to an increase in the maximum value of μ". A coercive force of 240 A/m or less unfavorably results in an increased value of μ" in a 13.56 Mhz band.

The soft magnetic flaky powder preferably has a saturation magnetization value of 1.0 T or more, and more preferably 1.3 T or more. A low saturation magnetization value is unfavorable because of making it impossible to secure a value of μ' and of making it difficult to obtain demanded properties even if sheet molding is devised.

The ratio of the tap density to the true density of the soft magnetic flaky powder is preferably 0.22 or less and more preferably 0.18 or less. The lower limit of the ratio of the tap density to the true density is not particularly limited, but the tap density tends to monotonously decrease with proceeding of processing. Extremely long-time processing is unfavorable because of resulting in decrease in average particle diameter and in increase in coercive force. The aspect ratio of the soft magnetic flaky powder of the present invention (the ratio between the major diameter of the flaky powder and the minor diameter of the flaky powder) is preferably 30 or more. An aspect ratio of less than 30 results in increase in demagnetizing field and in decrease in apparent magnetic permeability.

The concentration of oxygen contained in the soft magnetic flaky powder of the present invention is preferably 0.7 mass % or less and more preferably 0.5 mass % or less. Existence forms of oxygen in the soft magnetic flaky powder can be considered to include two forms of grain boundary precipitation oxide and powder surface oxide, both of which are unfavorable because of being able to be considered to cause a coercive force to be increased. The amount of grain boundary precipitation oxide can be reduced by suppressing oxidation in the step of preparing a raw soft magnetic spherical powder and the flattening-processing step. Further, the amount of powder surface oxide can be reduced by suppressing oxidation in the flattening-processing step and the heat treatment step.

The numerical value of the magnetic permeability is evaluated by measuring a magnetic permeability after sheet molding. This value depends not only on the properties of the powder in itself but also on sheet molding conditions such as the filling rate and orientation state of the powder. When a sheet of which the imaginary part μ" of the magnetic permeability is 0.3 to 1 is produced using this powder, the real part μ' of the powder is preferably 45 or more, more preferably 55 or more, and still more preferably 60 or more.

A surface-treated powder may be preferred from the viewpoint of, e.g., enhancing insulating properties after sheet molding. The powder produced by the flattening-processing method of the present invention may be additionally subjected to a surface treatment step as needed in the heat treatment step or before and after the heat treatment step. For example, the heat treatment may be performed under an atmosphere containing a minute amount of active gas. Corrosion resistance or dispersibility in rubber can also be improved by surface treatment, typified by surface treatment with a conventionally proposed cyanide coupling agent.

A method for producing a magnetic sheet is also enabled by a conventionally proposed method. For example, the production is enabled by dissolving chlorinated polyethylene or the like in toluene, mixing the solution with a flaky powder, applying and drying the mixture, and compressing the resultant by various presses or rollers.

EXAMPLES

The present invention will be specifically described below with reference to Examples.

(Production of Flaky Powder)

A powder with predetermined components was produced by a gas atomization method or a disk atomization method, and was classified into 150 μm or less. The gas atomization was performed by using a crucible made of alumina for melting, tapping a molten alloy metal from a nozzle having a diameter of 5 mm in the lower portion of the crucible, and spraying the molten alloy metal with high-pressure argon. The powder was flattening-processed as a raw powder by an attritor. The processing was performed by the attritor, in which a ball of 4.8 mm in diameter made of SUJ2 was used and put together with the raw powder and industrial ethanol into a stirring vessel, and the rotation number of a blade was set at 300 rpm. The amount of the added industrial ethanol was set at 200 to 500 parts by mass with respect to 100 parts by mass of the raw powder. A flattening auxiliary was not added or was set at 1 to 5 parts by mass with respect to 100 parts by mass of the raw powder. The flaky powder and industrial ethanol taken out from the stirring vessel after the flattening-processing were transferred to a dish made of stainless steel, and dried at 80° C. for 24 hours. The flaky powder obtained in such a manner was heat-treated in a vacuum or in an argon gas at 500 to 900° C. for 2 hours, and used for various evaluations.

(Evaluation of Flaky Powder)

The average particle diameter and coercive forces of the obtained flaky powder were evaluated. The average particle diameter was evaluated by a laser diffraction method, and the true density was evaluated by a gas substitution method. The tap density was evaluated by a filling density measured after tapping 200 times at a drop height of 10 mm by filling about 20 g of the flaky powder into a cylinder having a capacity of 100 $cm^3$. For the coercive forces, the flaky powder was filled into a vessel made of resin of 6 mm in diameter and 8 mm in height, and values in the case of magnetization in the height direction of the vessel and in the case of magnetization in the diameter direction of the vessel were measured. Because the height direction of the filled column becomes the thickness direction of the flaky powder, the value in the case of the magnetization in the height direction of the vessel is the coercive force in the thickness direction of the flaky powder, and the value in the case of the magnetization in the diameter direction of the vessel is the coercive force in the longitudinal direction of the flaky powder. An applied magnetic field was 144 kA/m.

(Production and Evaluation of Magnetic Sheet)

Chlorinated polyethylene was dissolved in toluene, and the obtained flaky powder was mixed and dispersed in the solution. The dispersion liquid was applied to polyester resin to have a thickness of around 1 mm, and dried at normal temperature and normal humidity. Then, the resultant was pressed at 130° C. and a pressure of 15 MPa to obtain a magnetic sheet. The magnetic sheet has a size of 150 mm×150 mm and a thickness of 100 μm. Each volume filling rate of the flaky powder in the magnetic sheet was about 50%. Then, the magnetic sheet was cuts into a doughnut shape having an outer diameter of 7 mm and an inner diameter of 3 mm, an impedance characteristic at 1 MHz was measured at room temperature by an impedance measurement instrument, and a magnetic permeability (real and imaginary parts of complex magnetic permeability: μ' and μ") was calculated from the result. Further, a cross section of the obtained magnetic sheet was filled with resin and polished, the longitudinal lengths and thicknesses of 50 powders were randomly measured based on the optical microscope image thereof, and the average of the ratios of the longitudinal lengths and thicknesses was regarded as an aspect ratio. The present invention has been described above with reference to Examples. However, the present invention is not particularly limited to the examples. Further, comparative examples were produced by changing, as appropriate, conditions shown in Table 1 described later. Evaluation results are shown in Table 1.

TABLE 1

| | Composition of Raw Powder (mass %) | | | Method for Producing | Average Particle Diameter | Aspect Ratio of Flaky | Heat Treatment |
|---|---|---|---|---|---|---|---|
| No | Si | Cr | Fe | Raw Powder | $D_{50}$ (μm) | Powder | Atmosphere |
| 1 | 14 | 2 | Bal. | GA | 60 | 48 | Ar |
| 2 | 13 | 2 | Bal. | GA | 35 | 58 | Ar |
| 3 | 10 | 15 | Bal. | GA | 118 | 56 | Ar |
| 4 | 10 | 15 | Bal. | GA | 52 | 56 | Ar |
| 5 | 10 | 12 | Bal. | GA | 135 | 64 | Ar |
| 6 | 10 | 10.5 | Bal. | GA | 102 | 53 | Ar |
| 7 | 8 | 15 | Bal. | GA | 102 | 80 | Ar |

TABLE 1-continued

| | | | | | | | |
|---|---|---|---|---|---|---|---|
| 8 | 8 | 12 | Bal. | GA | 139 | 93 | Ar |
| 9 | 8 | 7 | Bal. | GA | 88 | 58 | Ar |
| 10 | 5 | 18 | Bal. | GA | 153 | 88 | Ar |
| 11 | 5 | 15 | Bal. | GA | 95 | 45 | Ar |
| 12 | 5 | 15 | Bal. | GA | 105 | 51 | Ar |
| 13 | 5 | 15 | Bal. | GA | 152 | 51 | Ar |
| 14 | 5 | 15 | Bal. | GA | 98 | 48 | Vacuum |
| 15 | 5 | 15 | Bal. | DA | 90 | 33 | Vacuum |
| 16 | 5 | 15 | Bal. | GA | 93 | 30 | Vacuum |
| 17 | 5 | 12 | Bal. | GA | 171 | 82 | Ar |
| 18 | 5 | 7 | Bal. | GA | 111 | 32 | Ar |
| 19 | 15.1 | 15 | Bal. | GA | 34 | 30 | Ar |
| 20 | 15.1 | 12 | Bal. | GA | 43 | 50 | Ar |
| 21 | 15.1 | 2 | Bal. | GA | 28 | 42 | Ar |
| 22 | 12 | 15 | Bal. | GA | 65 | 52 | Ar |
| 23 | 12 | 12 | Bal. | GA | 73 | 80 | Ar |
| 24 | 17 | 7 | Bal. | GA | 56 | 60 | Ar |
| 25 | 10 | 20 | Bal. | GA | 22 | 30 | Ar |
| 26 | 10 | 18 | Bal. | GA | 123 | 71 | Ar |
| 27 | 10 | 16.5 | Bal. | GA | 143 | 73 | Ar |
| 28 | 10 | 15 | Bal. | GA | 24 | 5 | Ar |
| 29 | 10 | 15 | Bal. | GA | 74 | 22 | Ar |
| 30 | 8 | 20 | Bal. | GA | 43 | 53 | Ar |
| 31 | 8 | 2 | Bal. | GA | 150 | 139 | Ar |
| 32 | 5 | 15 | Bal. | GA | 152 | 51 | Nitrogen |

| No | Heat Treatment Temperature (°C) | Saturation Magneti-zation (T) | Coercive Force in Longitudinal Direction (A/m) | Real Part Number of Complex Magnetic Permeability of Sheet | Imaginary Part of Complex Magnetic Permeability of Sheet | Remarks |
|---|---|---|---|---|---|---|
| 1 | 600 | 1.1 | 343 | 53 | 1.0 | Present |
| 2 | 800 | 1.1 | 346 | 50 | 0.9 | Invention |
| 3 | 810 | 1.0 | 288 | 58 | 1.0 | Examples |
| 4 | 810 | 1.0 | 480 | 50 | 0.6 | |
| 5 | 800 | 1.1 | 308 | 52 | 1.0 | |
| 6 | 800 | 1.1 | 452 | 45 | 0.7 | |
| 7 | 800 | 1.2 | 479 | 68 | 0.9 | |
| 8 | 800 | 1.3 | 341 | 65 | 0.8 | |
| 9 | 700 | 1.4 | 405 | 59 | 0.9 | |
| 10 | 800 | 1.3 | 503 | 46 | 0.6 | |
| 11 | 810 | 1.3 | 432 | 50 | 0.8 | |
| 12 | 810 | 1.3 | 440 | 49 | 0.6 | |
| 13 | 600 | 1.3 | 500 | 50 | 0.8 | |
| 14 | 900 | 1.3 | 341 | 65 | 0.7 | |
| 15 | 500 | 1.3 | 480 | 60 | 0.3 | |
| 16 | 500 | 1.3 | 288 | 52 | 1.0 | |
| 17 | 800 | 1.5 | 638 | 45 | 0.3 | |
| 18 | 700 | 1.6 | 608 | 45 | 0.5 | |
| 19 | 800 | 0.7 | 925 | 16 | 0.3 | Comparative |
| 20 | 800 | 0.8 | 882 | 18 | 0.3 | Examples |
| 21 | 500 | 1.0 | 408 | 42 | 0.7 | |
| 22 | 800 | 0.9 | 820 | 38 | 0.3 | |
| 23 | 800 | 0.8 | 586 | 31 | 0.4 | |
| 24 | 700 | 1.1 | 213 | 73 | 2.1 | |
| 25 | 900 | 0.8 | 674 | 20 | 0.6 | |
| 26 | 800 | 0.8 | 383 | 35 | 0.7 | |
| 27 | 800 | 0.8 | 480 | 33 | 0.6 | |
| 28 | 800 | 1.0 | 304 | 27 | 15.0 | |
| 29 | 800 | 1.0 | 256 | 33 | 5.0 | |
| 30 | 900 | 1.0 | 322 | 49 | 1.1 | |
| 31 | 500 | 1.6 | 395 | 58 | 3.0 | |
| 32 | 500 | 1.3 | 960 | 30 | 0.8 | |

(NOTE 1)
The underlined figures fall outside the scope of the present invention.
(NOTE 2)
GA: gas atomization method,
DA: disk atomization method As shown in Table 1, Nos. 1 to 18 are present invention examples, while Nos. 19 to 32 are comparative examples.

Comparative Example Nos. 19 and 20 exhibit the large amounts of added Si and low saturation magnetization values in comparison with the present invention examples. In addition, high coercive force values and the low real values of magnetic permeability are exhibited. Comparative Example No. 21 exhibits the large amount of added Si and a small average particle diameter in comparison with the present invention examples. As a result, the slightly low real part value of magnetic permeability is exhibited.

Comparative Example Nos. 22, 23, 26, and 27 exhibit low saturation magnetization values in comparison with the present invention examples. In addition, No. 22 exhibits a high coercive force value. As a result, Comparative Example Nos. 22, 23, 26, and 27 exhibit the low real part values of magnetic permeability. No. 24 exhibits a low coercive force value and the high imaginary part value of magnetic permeability in comparison with the present invention examples. Comparative Example No. 25 exhibits the large amount of added Cr, a small average particle diameter, a low saturation magnetization value, and a high coercive force value. As a result, No. 25 exhibits the low real part value of magnetic permeability.

Comparative Example Nos. 28 and 29 exhibit low aspect ratios in comparison with the present invention examples. In addition, No. 28 exhibits a small average particle diameter. As a result, Nos. 28 and 29 exhibit the low real part values and high imaginary part values of magnetic permeability. Comparative Example No. 30 exhibits the slightly high imaginary part value of magnetic permeability due to the large amount of added Cr in comparison with the present invention examples. Comparative Example No. 31 unfavorably exhibits the small amounts of both of added Si and Cr and a high imaginary part of magnetic permeability of 3.0 in comparison with the present invention examples.

Comparative Example No. 32 is heat-treated in nitrogen and exhibits a high coercive force value and the low real part value of magnetic permeability in comparison with the present invention examples. In contrast, all of the present invention Nos. 1 to 18 made it possible to produce a soft magnetic flaky powder having excellent sheet moldability and a high magnetic permeability because of satisfying the conditions of the present invention.

The invention claimed is:

1. A soft magnetic flaky powder obtained by flattening-treatment of a soft magnetic powder, wherein an average particle diameter $D_{50}$ is more than 30 μm, a coercive force Hc measured by applying a magnetic field in the longitudinal direction of the flaky powder is in a range of 240 to 640 A/m, a saturation magnetization is 1.0 T or more, and an aspect ratio is 30 or more, wherein the soft magnetic flaky powder comprises an Fe—Si—Cr alloy comprising Si: 15 mass % or less excluding zero, Cr: from more than 6 mass % to 18 mass %, and the balance of Fe with unavoidable impurities, and wherein the soft magnetic flaky powder has a real magnetic permeability μ' of 45 or more and an imaginary magnetic permeability μ" of 1 or less, which are magnetic properties in an RFID use or a 13.56 MHz band.

2. A method for producing the soft magnetic flaky powder of claim 1, comprising implementing a raw powder production step and a flattening-processing step of flattening the raw powder, thereby obtaining the soft magnetic flaky powder.

3. A method for producing the soft magnetic flaky powder of claim 1, comprising implementing a raw powder production step using a gas atomization method or a disk atomization method, a flattening-processing step of flattening the raw powder, and a heat-treating step of heating the flattening-processed powder in a vacuum or argon atmosphere at 500° C. to 900° C., thereby obtaining the soft magnetic flaky powder.

* * * * *